US005092430A

United States Patent [19]

Goto et al.

[11] Patent Number: 5,092,430

[45] Date of Patent: Mar. 3, 1992

[54] METHOD OF OPERATING COMMON ELEVATOR

[75] Inventors: Hideki Goto; Kenzo Tatino, both of Inazawa, Japan

[73] Assignee: Mitsubishi Denki Kabushiki Kaisha, Japan

[21] Appl. No.: 717,466

[22] Filed: Jun. 19, 1991

[30] Foreign Application Priority Data

Jun. 22, 1990 [JP] Japan ..... 2-162813

[51] Int. Cl.[5] ..... B66B 1/34

[52] U.S. Cl. ..... 187/122; 187/125; 187/126

[58] Field of Search ..... 187/121, 125, 126; 192/41 A; 52/234

[56] References Cited

U.S. PATENT DOCUMENTS 4,084,661 4/1978 Quan et al. ..... 187/125
4,352,412 10/1982 Bittar et al. ..... 187/126
4,431,086 2/1984 Moser et al. ..... 187/125
4,766,987 8/1988 Message ..... 192/41 A
4,918,889 4/1990 Lundstrom et al. ..... 52/234

*Primary Examiner*—A. D. Pellinen
*Assistant Examiner*—Lawrence E. Colbert
*Attorney, Agent, or Firm*—Leydig, Voit & Mayer

[57] ABSTRACT

A method of operating a common elevator in a composite building which contains a plurality of types of exclusively used floors provided separately from each other and corresponding to a plurality of objectives, and a plurality of lobby floors provided separately from each other and corresponding to the plurality of types of exclusively used floors comprises the steps of selecting either of a plurality of operation modes respectively corresponding to the plurality of types of exclusively used floors and offering an elevator service only to the corresponding exclusively used floors and to the corresponding lobby floor, determining the presence or absence of users of the elevator in the selected operation mode, and changing over the operation mode to the other operation mode among the plurality of operation modes when it is determined that there is no user.

3 Claims, 3 Drawing Sheets

METHOD OF OPERATING COMMON ELEVATOR

BACKGROUND OF THE INVENTION

1. Field of the Invention

This invention relates to a method of operating a common elevator. More particularly, the present invention pertains to an elevator operating method in which the mode can be changed over during the operation of the elevator so as to change the type of floors to which the elevator is serviced.

2. Description of the Related Art

The usage of the conventional common elevator, disclosed in Japanese Patent Laid-Open No. 1-231793, will be described below with reference to FIG. 3. An office building 7 and a residential building 8 are attached. A common elevator 6 is installed on the adjoining portion between the two buildings. Normally, the major time period in which the elevator 6 is used in the office building 7 differs from that in which the elevator 6 is used in the residential building 8. Therefore, the period of non-use of the common elevator 6 can be reduced, and the operation efficiency of the elevator 6 can thus be increased.

In recent years, composite buildings 1 have been built in urban areas to enhance the land use efficiency. Such a composite building 1 ma contain office floors 3 which occupy the lower portion of the building 1 and residential floors 2 occupying the upper portion thereof, as shown in FIG. 4. In the composite building 1, elevator service is offered for both the floors 3 and 2 using a common elevator 4 which travels to all floors, including the office floors 3 and the residential floors 2.

However, the common elevator 4 may violate the privacy of the residents who live on the residential floors 2 and permit violation of the security of the office floors 3. Hence, in a case where provision of the privacy of the residents on the residential floors 2 and of the security of the office floors 3 is required, common elevators are not installed but elevators are installed and operated separately for the individual residential floors and office floors.

However, the provision of separate elevators for residential and office floors in a composite building increases installation costs and space. Furthermore, since the time periods in which the elevators exclusively used for the residential floors is used generally differ from the time that the elevators exclusively used for the office floors is used. Therefore, the frequency with which the elevators are used is reduced, thus reducing operational efficiency thereof, which is uneconomical.

SUMMARY OF THE INVENTION

Accordingly, an object of the present invention is to provide a method of operating a common elevator in a composite building which contains a plurality of types of exclusively used floors provided separately from each other and corresponding to a plurality of objectives, and a plurality of lobby floors provided separately from each other and corresponding to the plurality of types of exclusively used floors. The operation method comprises the steps of selecting either of a plurality of operation modes respectively corresponding to the plurality of types of exclusively used floors and offering an elevator service only to the corresponding exclusively used floors and to the corresponding lobby floor, determining the presence or absence of users of the elevator in the selected operation mode, and changing over the operation mode to the other operation mode among the plurality of operation modes when it is determined that there is no user.

DESCRIPTION OF THE PREFERRED EMBODIMENTS

An embodiment of the present invention will now be described with reference to the accompanying drawings.

Figure 1:
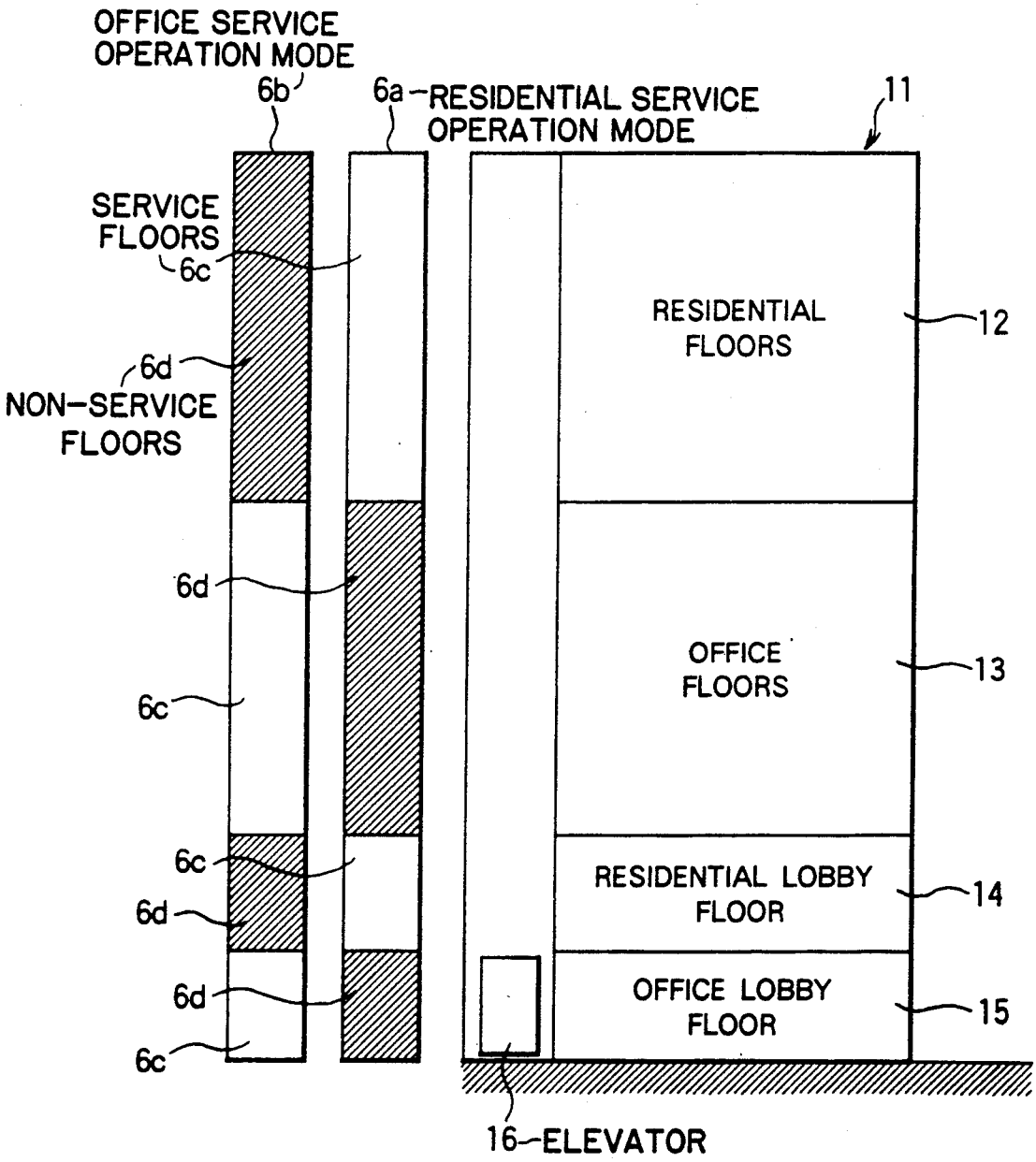
FIG. 1 shows the operation modes in the method of operating an elevator for common use showing an embodiment according to the present invention.

Referring first to FIG. 1, a composite building 11 includes residential floors 12 which occupy an upper portion of the building and office floors 13 which occupy a lower portion thereof. Elevator service is offered for both the residential and office floors 12 and 13 using a common elevator 16. The composite building 11 also has a residential lobby floor 14 and an office lobby floor 15 on different floors below the office floors 13. Reference numerals 6*a* and 6*b* each denote the elevator operation mode. The operation mode 6*a* is one for use for residential service which offers elevator service exclusively for the residential floors 12 and the residential lobby floor 14, and the operation mode 6*b* is one for use in the office service which offers elevator service exclusively for the office floors 13 and the office lobby floor 15. Reference numerals 6*c* and 6*d* respectively denote service floors where the elevator can stop and non-service floors where the elevator does not stop.

As the composite building 11 has the residential lobby floor 14 and the office lobby floor 15 separately, residents on the residential floor use the common elevator 16 on the residential lobby floor 14, while the office personnel and others who have business therein use the common elevator 16 on the office lobby floor 15. At that time, since the residents on the residential floors always use the common elevator 16 in the mode for residential service, they are prohibited from going to any floor other than residential ones. The office personnel and other who have business therein always use the common elevator 16 which is operated in the mode for office service, and thus cannot go to any floor other than the office floors. That is, the residents on the residential floors and the office personnel on the office floors do not utilize the common elevator 16 simultaneously, and privacy and security of the residents on the residential floors 12 and security on the office floors 13 are thus secured.

An adequate ID card may be introduced so as to restrict entrance of users of the residential lobby floor 14 and that of the users of the office lobby floor 15 separately. In this way, outsiders can be reliably restricted, thus preventing crimes and enhancing management.

Figure 2:
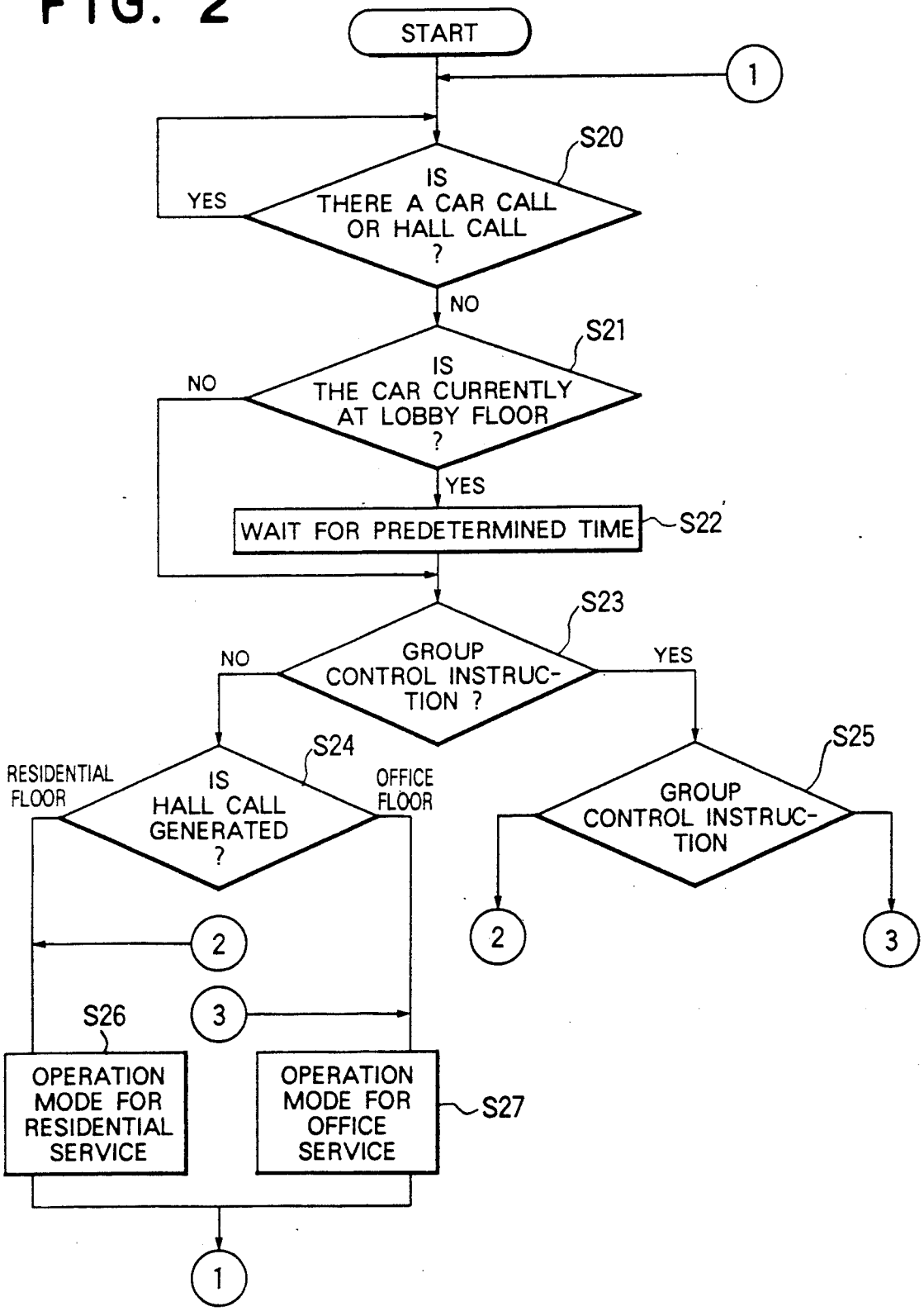
FIG. 2 is a flowchart of the embodiment of FIG. 1.
Figure 3:
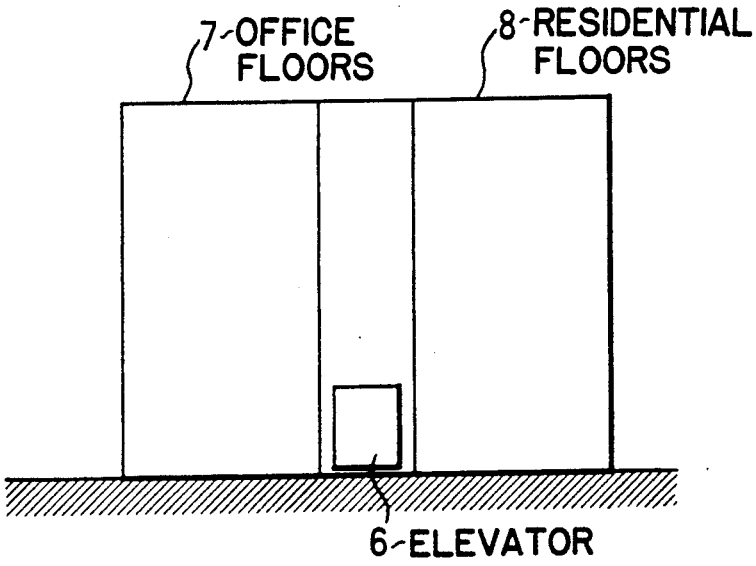
FIG. 3 PRIOR ART
FIG. 3 explains the usage of a conventional elevator for common use.
Figure 4:
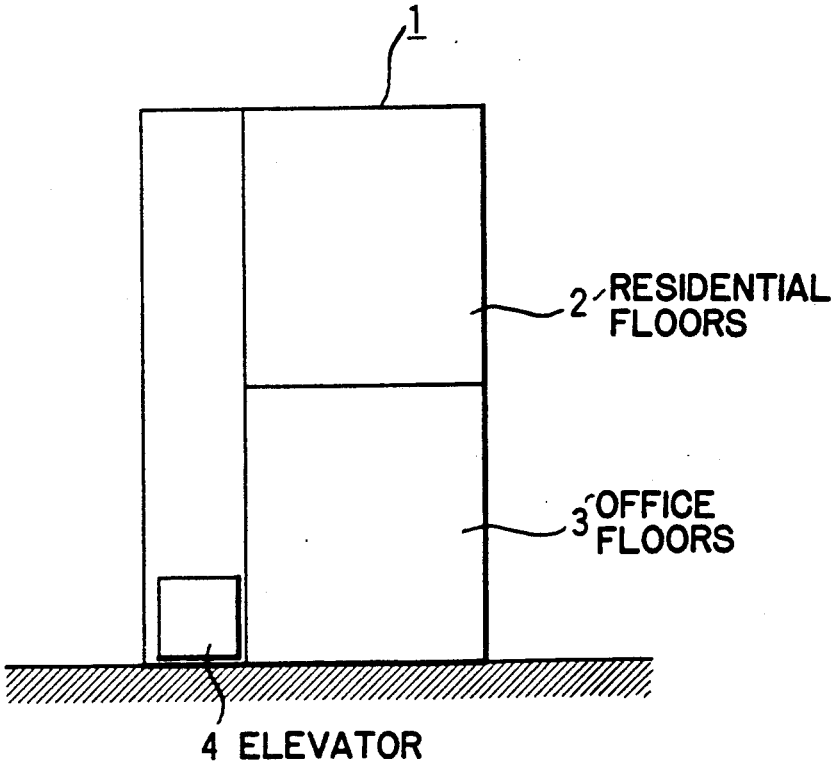
FIG. 4 PRIOR ART
FIG. 4 explains the usage of a conventional common elevator in a composite building.

Now, the switching method between the operation mode 6*a* for residential service and that 6*b* for office service will be described with reference to FIG. 2. This change-over of the operation mode is conducted in a state where users of the elevator are absent, i.e., in a state where no passengers are present in the car.

First, in step S20, it is determined whether or not there is a car call or a hall call from the floor to which the elevator service is offered in the current operation mode. If there is neither the car call nor hall call, it is determined that there is no passenger of the elevator 16 in the current operation mode, and the process goes to step S21 where it is determined whether or not the current position of the car is at the lobby floor 14 or 15. If the car is either on the lobby floor 14 or 15, arrival of the user is awaited for a predetermined period of time in step S22. Thereafter, it is determined in step S23 whether or not there is a group control instruction to be used for operating the elevator. If it is determined in step S21 that the car is not neither on the lobby floor 14 nor 15, the process goes directly from step S21 to step S23.

If it is determined in step S23 that there is no group control instruction, generation of a hall call is detected in step S24. When the hall call is generated on the residential floor (on the residential floors 12 or on the residential lobby floor 14), the operation mode 6*a* for residential service is selected in step S26. When the hall call is generated on the office floor (on the office floors 13 or on the office lobby floor 15), the operation mode 6*b* for office service is selected.

If it is determined in step S23 that there is a group control instruction, a plurality of elevator cars which are the control subjects are allotted to both the residential and office services in a predetermined proportion on the basis of the group control instruction made in step S25, and then the process forcibly goes to step S26 or S27 even when there is no hall call to select the operation mode of each elevator car.

In the group control operation, as the number of users who utilize the elevator on the residential floors 12 and on the office floors 13 varies depending on the time period or the week day, the proportion of the number of elevators operated for residential service to that of the number of elevators operated for office service may accordingly be selected.

In the above-described embodiment, to determine the presence or absence of the users of the elevator, the presence or absence of the car call or hall hall is detected. However, the presence or absence of the users of the elevator may also be determined by detecting users using an ITV camera or an adequate sensor provided in the car or on the hall. This allows for highly accurate detection.

As stated above, the time period in which the elevator is often operated for residential service differs from that in which the elevator is frequently operated for office service. Therefore, the operation mode of the elevator may be set to that for office service from, for example, 10 o'clock a.m. to 3 o'clock p.m. on week days. If the operation of the elevator in the operation mode for residential service is desired in the above time period, the operation mode of the elevator is changed over to the operation mode for residential service, and the elevator is operated for a predetermined period of time. Thereafter, if a user of the elevator in the mode for residential service does not appear for a predetermined period of time, the operation mode may be automatically returned to the operation mode for office service.

Furthermore, in a case where the residential floors 12 house a large number of houses, the residential floors 12 may be divided into a few groups, and a plurality of residential lobby floors corresponding to the individual groups may be provided. In this way, maintenance of privacy and security for the residents can further be improved. Also, a similar division may be made on the office floors 13 utilizing the type of business or a difference in the company.

In the above embodiment, the composite building which contains the residential floors and office floors has been described. However, the present invention can also be applied to a composite building which is used for many types of objectives, including a department store and a hotel, or to a building in which the elevator service is separately made for individual floors.

What is claimed is:

1. A method of operating a common elevator in a composite building which contains a plurality of types of exclusively used floors provided separately from each other and corresponding to a plurality of objectives, and a plurality of lobby floors provided separately from each other and corresponding to said plurality of types of exclusively used floors, comprising the steps of:

selecting either of a plurality of operation modes respectively corresponding to said plurality of types of exclusively used floors and offering an elevator service only to the corresponding exclusively used floors and to the corresponding lobby floor;

determining the presence or absence of users of the elevator in the selected operation mode; and changing over the operation mode to the other operation mode among said plurality of operation modes, when it is determined that there is no user.

2. The operation method according to claim 1 wherein switching to the other operation mode is conducted when it is determined that there is no user of the elevator in the selected operation mode and when a hall call in the other operation mode is generated.

3. The operation method according to claim 2 wherein a predetermined operation mode is selected in accordance with a time period, and wherein after the operation mode is changed over to the other operation mode, the operation mode is returned to said predetermined operation mode if it is determined that there is no user in the other operation mode.

* * * * *